US005587629A

United States Patent [19]

Gornstein

[11] Patent Number: 5,587,629

[45] Date of Patent: Dec. 24, 1996

[54] TRANSFORMERLESS HIGH-VOLTAGE GENERATOR CIRCUIT

[75] Inventor: Viktor L. Gornstein, New York, N.Y.

[73] Assignee: Philips Electronics North America Corporation, New York, N.Y.

[21] Appl. No.: 519,907

[22] Filed: Aug. 28, 1995

[51] Int. Cl.[6] ..... H05B 37/00

[52] U.S. Cl. ..... 315/200 R; 315/241 P; 315/200 A; 331/117 R; 331/167

[58] Field of Search ..... 315/200 R, 200 A, 315/205, 241 P; 331/117 R, 117 FE, 167

[56] References Cited

U.S. PATENT DOCUMENTS

| | | | |
|---|---|---|---|
| 4,593,255 | 6/1986 | Matsura | 331/117 R |
| 5,136,263 | 8/1992 | Lane | 331/158 |
| 5,150,081 | 9/1992 | Goldberg | 331/109 |
| 5,373,215 | 12/1994 | Steinkraus, Jr. | 315/200 R |
| 5,457,434 | 10/1995 | Partow | 331/117 FE |

OTHER PUBLICATIONS

"Electronic devices and circuit theory" by Boylestad et al., 1978, pp. 503–519.

Joseph J. Carr, "How to design oscillator circuits", Aug. 1986, pp. 54 and 55.

*Primary Examiner*—Robert Pascal
*Assistant Examiner*—Haissa Philogene
*Attorney, Agent, or Firm*—Steven R. Biren

[57] ABSTRACT

A transformerless high-voltage generator circuit includes an amplifier and a feedback circuit connected together to form an oscillator. Due to the configuration of the feedback circuit, a high-voltage output is obtained at an intermediate point within the feedback circuit without the use of a transformer. The resulting circuit may be used in various applications, such as an electronic photoflash unit, in order to reduce the size, weight and cost of the finished product by eliminating the need for a transformer to obtain the desired high voltage.

6 Claims, 1 Drawing Sheet

TRANSFORMERLESS HIGH-VOLTAGE GENERATOR CIRCUIT

BACKGROUND OF THE INVENTION

This invention is in the field of high-voltage generator circuits, and relates more particularly to circuits capable of generating a high voltage without the use of a transformer.

Typical electronic circuits using transistors and integrated circuits generally employ a relatively low-voltage (i.e. under 20 volts) power source. Thus, for circuit applications requiring a relatively high voltage (i.e. substantially over 20 volts), special circuitry must be incorporated in order to generate the desired high voltage from the available low voltage.

A typical prior-art technique for generating a high voltage involves powering an oscillator circuit from a low-voltage DC source to generate a low-voltage AC signal, and then using a step-up transformer to generate a high-voltage AC signal. If desired, the high-voltage AC signal can then be rectified to provide a high-voltage DC output.

However, the use of a step-up transformer entails a number of drawbacks, resulting from the size, weight and cost of the step-up transformer. Such disadvantages become particularly significant in small, portable electronic devices employing transistors and/or integrated circuits, such as photoflash units, where size, weight and cost are major considerations.

Accordingly, it would be desirable to have a high-voltage generator circuit which does not require the use of a step-up transformer to generate the high voltage, in order to achieve an economical, compact and lightweight high-voltage generator circuit.

SUMMARY OF THE INVENTION

It is thus an object of the invention to provide a high-voltage generator circuit which does not require a step-up transformer to generate a high-voltage signal. It is a further object of the invention to provide a high-voltage generator circuit which is simple, compact and lightweight in design and economical to manufacture. In accordance with the invention, these objects are achieved by a new circuit which generates a high voltage without using a step-up transformer. Instead, the high-voltage generator circuit of the invention uses an amplifier in combination with a feedback circuit to form an oscillator, with a high-voltage output signal being generated within the feedback circuit.

In a preferred embodiment of the invention, the feedback circuit is coupled between an output terminal and an inverting input terminal of the amplifier in order to cause the circuit to oscillate during operation. The feedback circuit includes a resistor coupled between the amplifier output terminal and the inverting input terminal, with first and second capacitors coupled in series between the amplifier output terminal and the inverting input terminal, and with a common connection between the first and second capacitors forming a high-voltage output terminal with respect to a common or ground terminal. The basic feedback circuit is completed by an inductor which is coupled between the high-voltage output terminal and the common or ground terminal. In this manner, a high-voltage generator circuit is formed without the use of a step-up transformer.

In further preferred embodiments of the invention, an operational amplifier is used, and a load is coupled between the high-voltage output terminal and the common or ground terminal. If a high DC voltage is required, a rectifier may be coupled in series with the load, and the load may include a capacitor to filter and store the high DC voltage thus generated.

In yet a further preferred embodiment of the invention, a discharge lamp is switchably coupled in parallel with the capacitor in the load, and a resistor may be coupled in series with the load capacitor in order to limit the current drawn by the load from the high-voltage generator circuit.

In this manner, the invention provides a transformerless high-voltage generator circuit which is compact, lightweight and economical, and is thus particularly suitable for use in portable electronic equipment such as photoflash units, as well as in ignitor circuits for gas-filled lamps, high voltage television circuits, and other similar applications.

BRIEF DESCRIPTION OF THE DRAWING

The invention may be more completely understood with reference to the following detailed description, to be read in conjunction with the accompanying drawing, in which.

DESCRIPTION OF THE PREFERRED EMBODIMENTS

Figure 1:
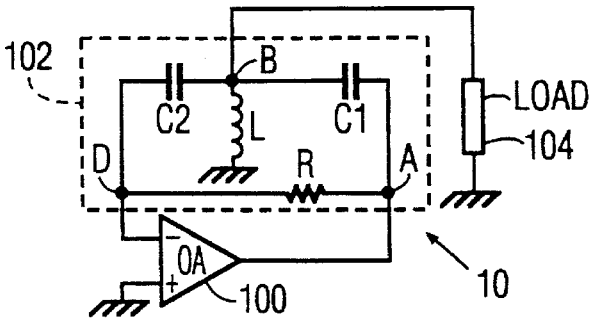
FIG. 1 shows a schematic diagram of a basic transformerless high-voltage generator circuit in accordance with the invention.

A basic transformerless high-voltage generator circuit 10 in accordance with the invention is shown in simplified schematic form in FIG. 1. The high-voltage generator circuit 10 includes an amplifier 100 (here an operational amplifier) having an inverting input terminal (–) connected to terminal D and a non-inverting input terminal (+) connected to a common terminal, here ground, and an output terminal connected to terminal A. A feedback circuit 102 is coupled between the amplifier output terminal at terminal A and the inverting input terminal at terminal D in order to cause the generator circuit to oscillate during operation.

The feedback circuit 102 includes a first resistor R coupled between terminals A and D, and first and second capacitors C1, C2 coupled in series between terminals A and D, with their common connection, at terminal B, forming a high-voltage output terminal for generating a high-voltage output with respect to the common terminal. The feedback circuit 102 also includes an inductor L coupled between terminal B and ground. The simplified circuit of FIG. 1 drives a load 104 coupled between the high-voltage output terminal B within the feedback circuit 102 and ground.

Figure 2:
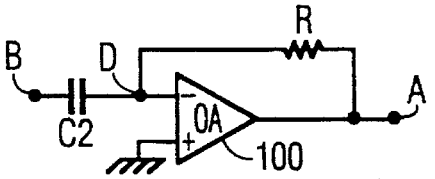
FIG. 2 shows a schematic equivalent circuit diagram of the amplifier shown in FIG. 1.
Figure 3:
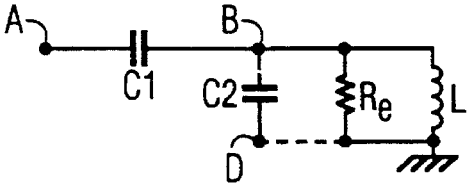
FIG. 3 shows a schematic equivalent circuit diagram of the feedback circuit of the transformerless high-voltage generator circuit of FIG. 1.

In order to more clearly describe the operation of the circuit of FIG. 1, the circuit is broken down into two partial equivalent circuit diagrams, as shown in FIGS. 2 and 3, with FIG. 2 showing a schematic equivalent circuit diagram of the amplifier portion of the circuit and the FIG. 3 showing a schematic equivalent circuit diagram of the feedback circuit portion of the high-voltage generator circuit. The principles of operation of the circuit of FIG. 1 will be explained below (following the description of FIG. 4) using the partial equivalent circuit diagrams of FIGS. 2 and 3. In FIGS. 2 and 3, the circuit components and terminals carry the same designations as the corresponding components and terminals in FIG. 1, with the exception of resistor Re in FIG. 3, which is an equivalent resistance corresponding to the parallel connection of the resistive components of the load 104 and the inductor L.

Figure 4:
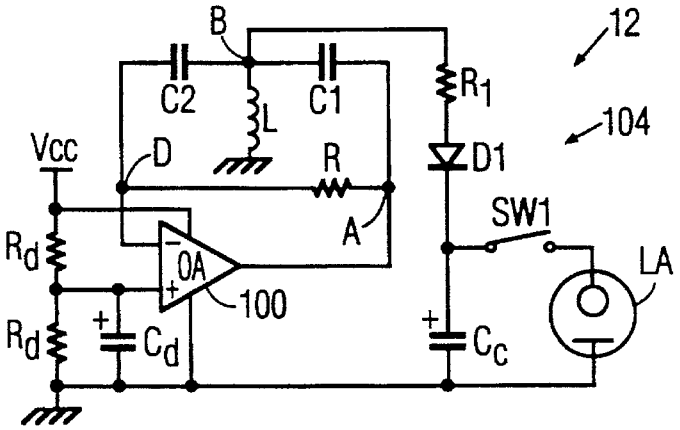
FIG. 4 shows a schematic diagram of an electronic photoflash circuit which uses the transformerless high-voltage generator circuit of the invention.

FIG. 4 shows a schematic diagram of a practical application of the basic transformerless high-voltage generator circuit of FIG. 1 in an electronic photoflash circuit 12. Components in FIG. 4 which correspond to the components previously described in connection with FIG. 1 bear the same reference designations as in FIG. 1 and are not further described here. In order to form the photoflash circuit 12 of FIG. 4, operational amplifier 100 is provided with power supply connections $V_{CC}$ and ground, and its noninverting input is provided with a biasing and filtering network including a voltage divider composed of two resistors $R_d$ and a capacitor $C_d$as shown. In order to utilize the high AC voltage generated at output terminal B during operation, the load 104 includes a current-limiting resistor $R_l$, a rectifying diode D1, and a capacitor $C_c$ connected in series between terminal B and ground. A switch SW1 and a photoflash lamp LA are connected in series across capacitor $C_c$ to complete the circuit. In operation, the high AC voltage generated at terminal B due to circuit oscillation is rectified by diode D1 and current-limited by resistor $R_l$, and then used to charge capacitor $C_c$ to a high DC voltage. Subsequently, when it is desired to activate the flash unit, switch SW1 is closed, and the high DC voltage stored across capacitor $C_c$ is discharged through lamp LA, thus causing the lamp to fire.

An analysis of the generator circuit of the invention can be done by obtaining a complex value of a Loop Gain Coefficient $K_L$ which can be represented as the product of a Gain Coefficient $K_{BA}$ and a Feedback Coefficient $K_{AB}$:

$$K_L=K_{BA}K_{AB}. \tag{1}$$

The amplifier equivalent circuit diagram is shown in FIG. 2 and the complex value of its Gain Coefficient is:

$$K_{BA}(j\omega)=-j\omega RC_2. \tag{2}$$

The feedback circuit equivalent diagram is shown in FIG. 3, and reflects the performance of the feedback circuit taking into consideration that node D in FIGS. 1, 2 and 3 is at virtual ground. $R_e$ is an equivalent resistance which represents the resistance of the parallel connection of the load 104 and the inductor L.

The Feedback Coefficient is:

$$K_{AB}=\frac{X_e}{X_e+X_{C1}}\ ; \tag{3}$$

where Xe is an impedance between node B and ground;

$$X_{C1}=1/j\omega C_1;\ \text{and} \tag{4}$$

$$X_e=\frac{1}{(1/R_e)+j\omega C_2+(1/j\omega L)}=\frac{j\omega R_eL}{j\omega L+R_e(1-\omega^2LC_2)}. \tag{5}$$

Substituting the values of $X_{C1}$ and $X_e$ from equations (4) and (5) into equation (3) will produce:

$$K_{AB}(j\omega)=\frac{\dfrac{j\omega R_eL}{j\omega L+R_e(1-\omega^2LC_2)}}{\dfrac{1}{j\omega C_1}+\dfrac{j\omega R_eL}{j\omega L+R_e(1-\omega^2LC_2)}}= \tag{6}$$

-continued $$\frac{-\omega^2R_eLC_1}{j\omega L+R_e[1-\omega^2L(C_1+C_2)]}\ ;\ \text{and}$$

substituting the values of $K_{BA}$ and $K_{AB}$ from equations (2) and (6) into equation (1) will result in the following:

$$K_L(j\omega)=\frac{j\omega^3RR_eLC_1C_2}{j\omega L+R_e[1-\omega^2L(C_1+C_2)]}. \tag{7}$$

From the foregoing analysis, the following conclusions can be drawn:

1) The Nyquist Oscillation Conditions are:

$$\text{Im}\ [K_L(j\omega)]=0;\ \text{and} \tag{8}$$

$$|K_L(j\omega)|\geqq 1. \tag{9}$$

This results in oscillation frequency and minimum gain condition formulas as follows:

$$\omega o=1/\sqrt{L(C_1+C_2)}\ ;\ \text{and} \tag{10}$$

$$\omega o^2RR_eC_1C_2\geqq 1. \tag{11}$$

2) Under condition (10) equation (6) will be:

$$K_{AB}(j\omega)=j\omega oR_eC_1. \tag{12}$$

Equation 12 reflects the resonance in the feedback circuit. It is possible to satisfy the condition $R_e>>1/\omega oC_1$ providing that $|K_{AB}(\omega o)|>>1$. This means that the voltage at node B will be much higher the than voltage at node A, thus achieving the object of the invention. For example, if amplifier 100 is supplied with a 5 VDC $V_{CC}$ source, the output voltage peak-to-peak amplitude will be 4 V, and if $C_1=C_2$, $Q=\omega oR_e(C_1+C_2)=200$, (Q is the quality factor), then the voltage $V_B=QV_A/2=141$ VAC.

To better understand the principles of operation of the invention, note that the oscillation condition be rewritten from equations 10 and 11 in another form, as follows:

$$RR_eC_1C_2\geqq L(C_1+C_2).$$

The physical meaning of this formula is that the circuit will oscillate if the gain coefficient is large enough to compensate for the losses in the feedback circuit.

The loop coefficient is frequency dependent, but under the above conditions it is greater than one in some frequency band, which is sufficient to ensure oscillation. Within this frequency band there is one frequency ωo for which the loop gain will have zero phase rotation. This frequency will be the frequency of the oscillation.

If, in addition to the oscillation condition, $R_e>>1/\omega oC_1$, the AC voltage drops on $C_1$ and $C_2$ are much higher than the vector sum of these voltage drops. This is a typical effect of voltage resonance. Peak-to-peak amplifier output voltage is $V_{CC}-2\Delta V$, where $V_{CC}$ is the power supply voltage and ΔV is an amplifier voltage-drop parameter (usually 0.5 V or 1.0 V). The effective amplifier output voltage is thus:

$$(V_{CC}-2\Delta V)/2\sqrt{2}\ .$$

For the practical implementation of the schematic of FIG. 4, amplifier 100 can be an operational amplifier, type LF351, ΔV=1.0 V, and $V_{CC}$=9.0 V. The oscillation frequency can be 100 kHz, so that $\omega o=2\pi\times10^5$; Let $C_1=C_2=330$ pf; L from the formula 11 will then be 3.84 mHn. The Q value of the coil at this frequency can be 400, if the appropriate coil core is used. This will provide $R_e=\omega oQL=965$ kΩ;

$K_{AB}=\omega o R_e C_1=200$; $V_A=(V_{CC}-2\Delta V)/2\sqrt{2}=2.47$ V;

$V_B=K_{AB}V_A=200\times 2.47=494$ V; and select $R=3/\omega o^2 R_e C_1 C_2=72\Omega$.

Since R was calculated to be three times higher than the minimum required for oscillation, $R_L$ can be at least equal to half of $R_e$. For this circuit, select $R_L=720$ kΩ, $C_C=100$ μf, and $R_e=10$ kΩ. The circuit with these values will then charge $C_C$ to the peak voltage $V_{max}=\sqrt{2}\times 494=696$ V, thus clearly meeting the object of the invention.

The invention thus provides a high-voltage generator circuit which does not require a step-up transformer to generate a high-voltage signal. Furthermore, the invention provides a transformerless high-voltage generator circuit which is simple, compact and lightweight in design and economical to manufacture. While the invention has been particularly shown and described with reference to several preferred embodiments thereof, it will be understood by those skilled in the art that various changes in form and detail may be made without departing from the spirit and scope of the invention.

What is claimed is:

1. A transformerless high-voltage generator circuit, which comprises:

an amplifier having an inverting input terminal, a noninverting input terminal, and an amplifier output terminal, said noninverting terminal being coupled to a common terminal; and a feedback circuit coupled between said amplifier output terminal and said inverting input terminal for causing said high-voltage generator circuit to oscillate during operation, said feedback circuit comprising:

a first resistor coupled between said amplifier output terminal and said inverting input terminal;

first and second capacitors coupled in series between said amplifier output terminal and said inverting input terminal, said first resistor being coupled in parallel with said first and second capacitors and a common connection between said first and second capacitors forming a high-voltage output terminal for generating a high-voltage output with respect to said common terminal; and an inductor coupled between said high-voltage output terminal and said common terminal and connected directly to said common terminal.

2. A transformerless high-voltage generator circuit as claimed in claim 1, wherein said amplifier comprises an operational amplifier.

3. A transformerless high-voltage generator circuit as claimed in claim 1, further comprising a load coupled between said high-voltage output terminal and said common terminal.

4. A transformerless high-voltage generator circuit as claimed in claim 3, further comprising a rectifier coupled in series with said load.

5. A transformerless high-voltage generator circuit as claimed in claim 4, wherein said load comprises a third capacitor and a discharge lamp switchably coupled in parallel with said third capacitor.

6. A transformerless high-voltage generator circuit as claimed in claim 5, wherein said load further comprises a second resistor coupled in series with said third capacitor.

* * * * *